US006024043A

United States Patent [19]

Ho

[11] Patent Number: 6,024,043

[45] Date of Patent: Feb. 15, 2000

[54] BOOK BANDS ASSEMBLY FOR A BOOK

[76] Inventor: I-Tung Ho, P.O. Box 90, Tainan City, Taiwan

[21] Appl. No.: 08/912,025

[22] Filed: Aug. 15, 1997

[51] Int. Cl.[7] ..... B42D 9/00

[52] U.S. Cl. ..... 116/234; 116/238; 116/239; 281/42

[58] Field of Search ..... 116/234–240; 281/42; D19/34

[56] References Cited

U.S. PATENT DOCUMENTS

| | | | |
|---|---|---|---|
| 838,386 | 12/1906 | Crouch | 116/234 |
| 1,084,665 | 1/1914 | Sheldon | 116/235 |
| 1,346,856 | 7/1920 | Sprague | 116/239 |
| 1,809,943 | 6/1931 | Ockenden | 116/239 |
| 1,858,605 | 5/1932 | Von Alvensleben | 116/234 |
| 2,194,576 | 3/1940 | Truesdale | 116/234 |
| 5,408,950 | 4/1995 | Porto | 116/239 |
| 5,458,081 | 10/1995 | Reichert | 116/234 |
| 5,515,809 | 5/1996 | Weinberg | 116/235 |

FOREIGN PATENT DOCUMENTS

| | | | |
|---|---|---|---|
| 25359 | of 1910 | United Kingdom | 116/239 |
| 2275018 | 8/1994 | United Kingdom | 116/238 |

*Primary Examiner*—Andrew H. Hirshfeld

[57] ABSTRACT

Book bands pinched in a book include a plurality of book bands and a lateral band. The lateral band includes a band body, an adhesive layer on a lower surface of the band body and a removable paper covered on the adhesive layer. The book bands are colored and joined with the lateral band to be separately pinched in a book for finding important locations. The lateral band has its intermediate portion placed on an upper end of a book and two ends pinched between a book name page and a front cover and copyright page and a rear cover. Two flat pinchers are fixed around the intermediate portion of the lateral band.

1 Claim, 6 Drawing Sheets

BOOK BANDS ASSEMBLY FOR A BOOK

BACKGROUND OF THE INVENTION

This invention relates to book bands pinched in a book, particularly those possible to be separately pinched between two different pages for finding different important locations.

A traditional book band 406 shown in FIG. 5 has its upper end fixed in a back cloth 405 of a book back 404, extending from an upper end 407 out of a lower end 411 for a reader to easily find out a needed location for reading next time. But generally, a fine bound book may have only one band to use, and this sometimes is not sufficient in case of several important locations to be marked. Sometimes book marks are used for this purpose, or a corner of a page is bent as a mark, both of which are not ideal since book marks are liable to fall off a book and bent corners can harm a book.

SUMMARY OF THE INVENTION

The purpose of the invention is to offer a plurality of book bands to be pinched in a book, improving the disadvantage of the traditional one book band and book marks, and usable for three kinds of cases: (1) for reading for a short time, (2) for reading for comparatively long time, and (3) for reading permanently.

One feature of the invention is a lateral band to be placed or adhered on an upper end of a book, consisting of a band body, an adhesive layer coated on a lower surface of the band body and a removable paper covered on the adhesive layer to be removed in case of the band body needed to be fixed permanently on the upper end of a book. Two ends of the lateral band are bent and pinched respectively between a book name page and a front cover and a copyright page and a rear cover.

Another feature of the invention is a plurality of book bands having their upper ends joined with the lateral band and each band being separately pinched between two different pages for marking important locations to be easily found next time.

One more feature of the invention is two sophisticated flat pinchers fixed on an intermediate portion of the lateral band for decoration and advertisement.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
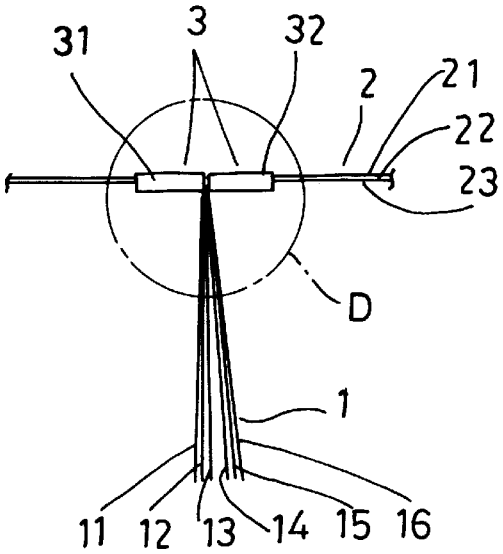
FIG. 1 is a front view of book bands pinched in a book in the present invention.
Figure 2:
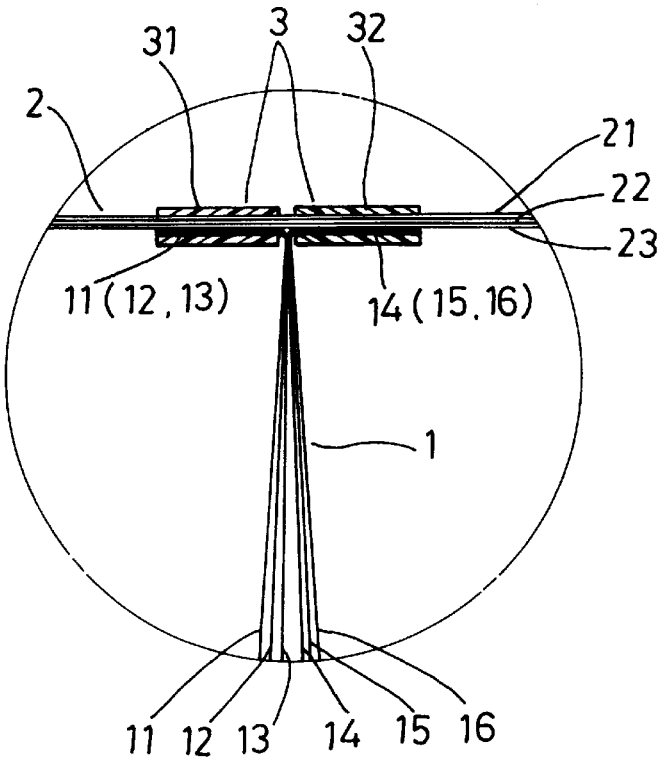
FIG. 2 is an enlarged cross-sectional view of a part marked D in FIG. 1.

A preferred embodiment of book bands pinched in a book in the present invention, as shown in FIGS. 1 and 2, includes a plurality of book bands 1, a lateral band 2, and two sophisticated flat pinchers 3, 3.

The book bands 1 are colored and made of soft woven strings, and in this embodiment six book bands are illustrated and marked 11, 12, 13, 14, 15 and 16. Each band can be pinched between any two intermediate pages 410 to indicate an important location to be later easily found. Thus, six colored book bands can indicate six different important locations, which is seldom seen in a traditional book 40. If more than six important locations are needed, the book bands in the present invention can be additionally fixed on a book, with no inconvenience in handling the book.

Figure 5:
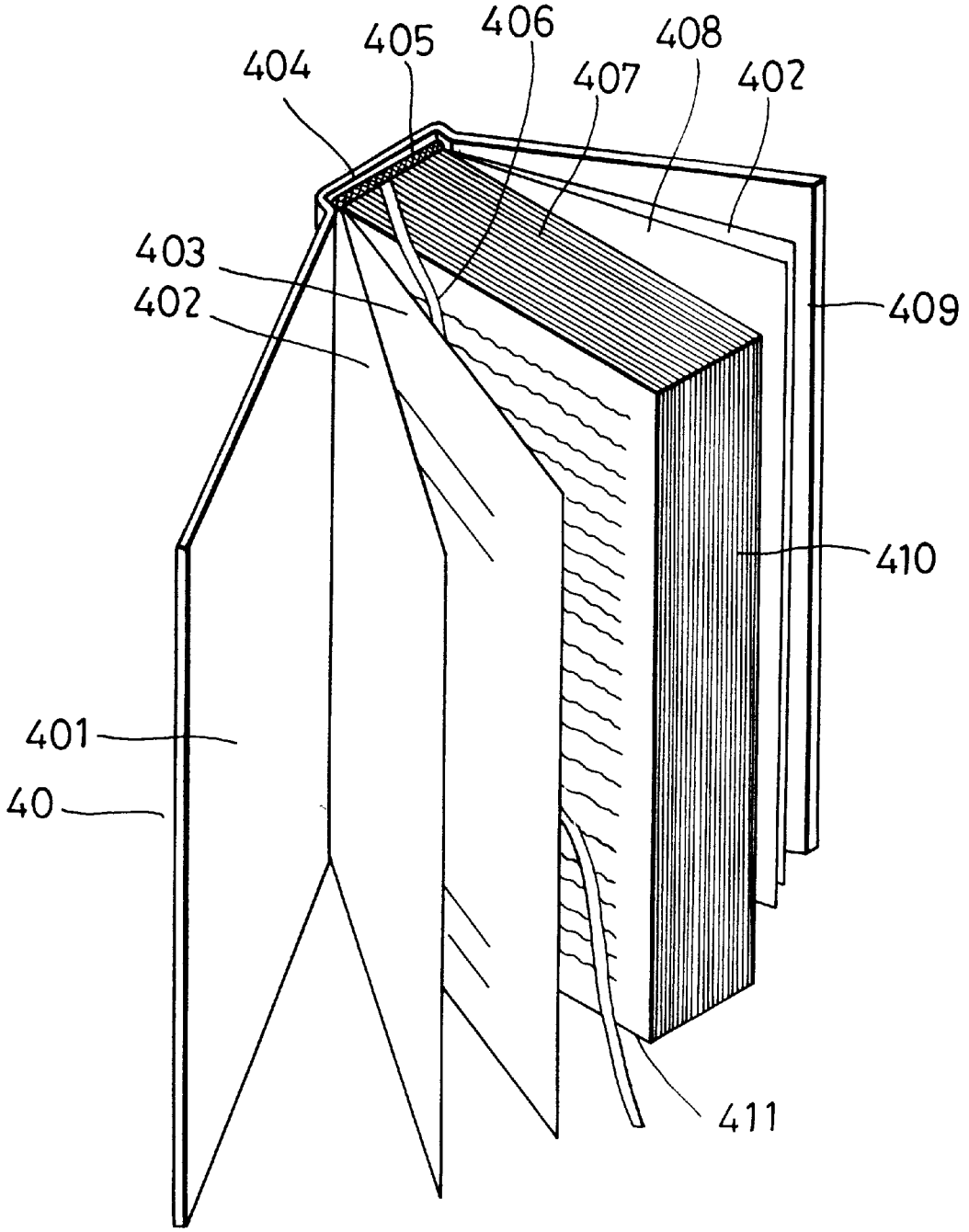
FIG. 5 (PRIOR ART)
FIG. 5 is a perspective view of a conventional book band pinched in a book.
Figure 6:
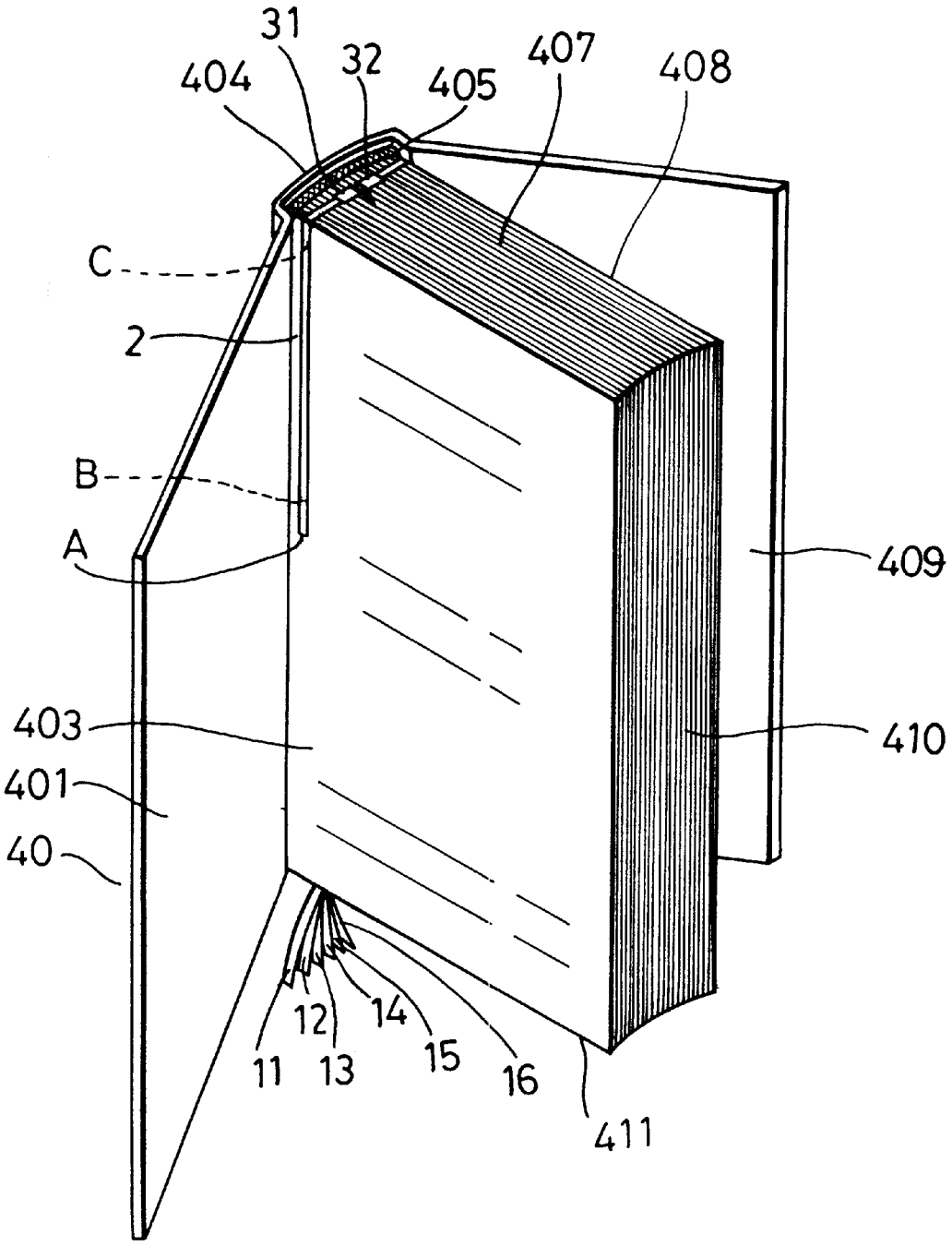
FIG. 6 is a perspective view of a preferred embodiment of the book bands pinched in a book not yet indicating important pages in the present invention.
Figure 7:
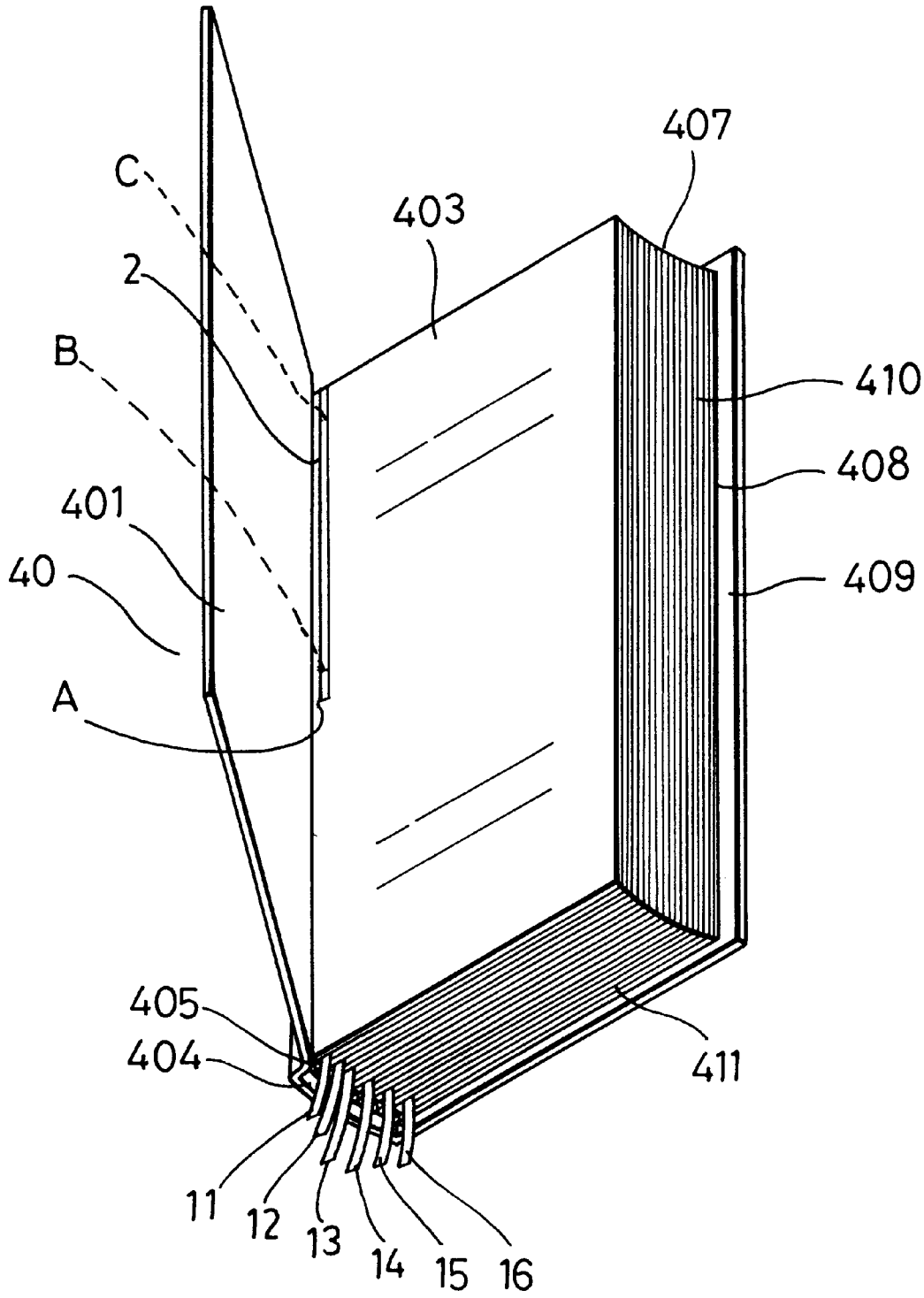
FIG. 7 is a perspective view of the preferred embodiment of the book bands pinched in a book, indicating important pages in the present invention; and, FIG. 8 is a perspective view of the book bands in the present invention combined on a conventional book with a book band, indicating important pages.
Figure 8:
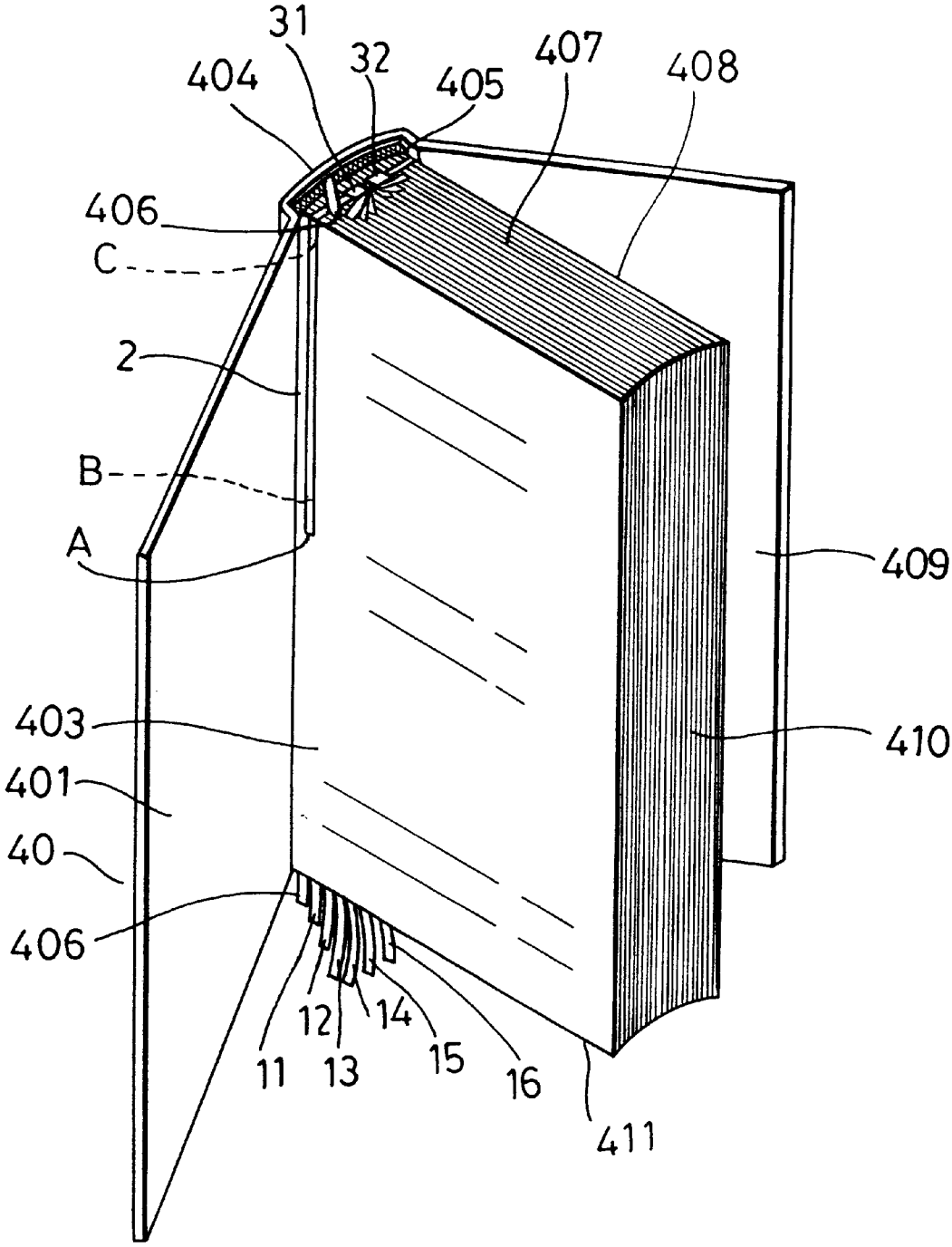

The lateral band 2 consists of a band body 21, an adhesive layer 22 and a removable paper layer 23 temporarily stuck on the adhesive layer 22 and removed when the book bands 1 are to be used. Then the exposed adhesive layer 22 can adhere the lateral band 21 on a book front or name page 403 and a back or copy right page 408, as shown in FIGS. 6, 7, and 8. Or the lateral band 21 can be adhered on a front and a rear binding page 402 as shown in FIG. 5. The lateral band 21 is also made of soft fine woven strings. Further, in order to enhance value and appearance, on an intermediate portion of the lateral band 2 can be fixed two flat pinchers 3, 3 pinching joint points there are the three colored hands 11, 12, and 13 with the other three colored bands 14, 15 and 16.

Figure 3:
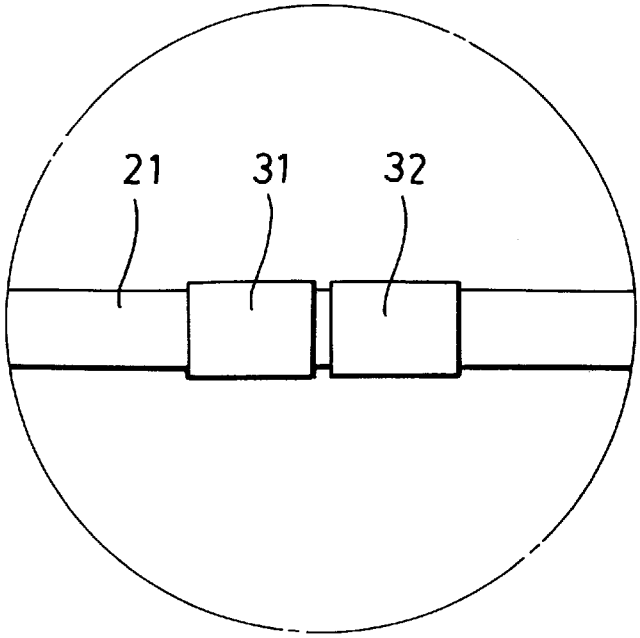
FIG. 3 is an upper view of the part marked D in FIG. 1.
Figure 4:
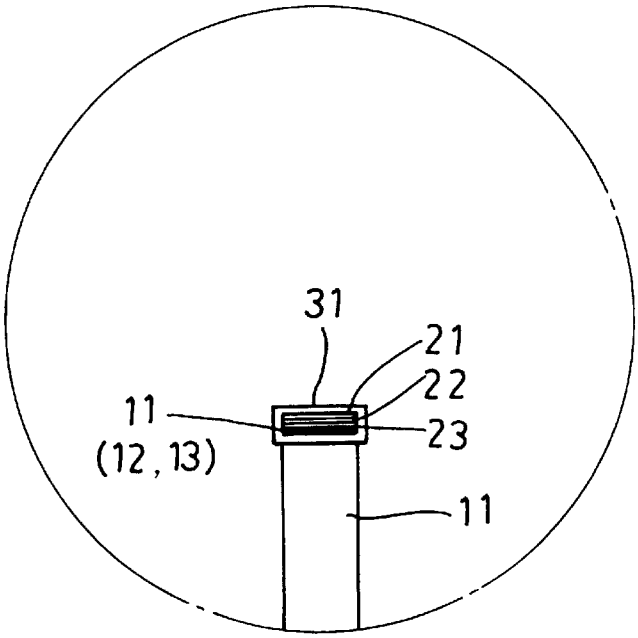
FIG. 4 is a side view of the part marked D in FIG. 1.

Referring to FIG. 3, another great feature of the invention, the flat pinchers 3, 3 respectively have a pinching surface 31 or 32 functioning not only as a kind of decoration, but also as an advertisement. A trademark, a picturesque design, a product name to be especially advertised or names of the owner for a scholar, a noble lady, a celebrity or an Imperial prince (princess) to keep in memory can be printed on the flat pinches 3, 3 just as rings or bracelets are worn on hands. The lateral band 21 is disposed on an upper side 407 of a book, the flat pinchers 3, 3 do not affect handling the book. Provided a book is very thick, flat pinchers 3, 3 only take a small portion of the upper side of the book, a separate flat pincher especially designed for a thick book can be added to fill empty portions of the lateral band 2 on the upper side of the book 40. Thus book is increased in the appearance, but of course the extra pincher is not indispensable.

FIG. 6 shows the book bands of the invention assembled in a book, with colored book bands 1 possible to be inserted between any two pages 410 from the upper side 407 of the book 40 down to the lower side 411, exposing a little out of the lower side 411 for a reader easily find out the page needed or to be changed to another location. When a band is pinched in the book 40, the band is to be pulled down, letting the lateral band 2 properly tightly contact on the upper side 407 of the book 40. Then the two ends of the lateral band 2 are pulled respectively to the book front or name page 403 and the back or copyright page 408 and bent down to be pinched between a front cover 401 and the rear cover 409. The mark A indicates the whole length of the lateral band 2 after bent in the book name page 403 and the copyright page 408. The mark B indicates final length of the removable paper layer 23 after a portion of same is removed if the colored book bands is to be used for a certain long period of time. The mark C indicates the final length of layer 23 for using the bands permanently.

FIG. 6 illustrates the book bands 1 all pinched together between two same pages. FIG. 7 illustrates the bands 11, 12, 13, 14, 15 and 16 all separately pinched between two different pages. FIG. 8 illustrates the book bands 1 fixed on a conventional book 40 with a conventional book band 406, with all the seven bands 406, 11, 12, 13, 14, 15 and 16 separately pinched between two different pages 410 with no inconvenience.

The book bands 1 of the invention have three uses: not fixed, temporarily fixed and permanently fixed, having two ends pinched respectively between the book front or name page 403 and the front cover 401, and between the back or copyright page 408 and the rear cover 409. They can be utilized in books of various thickness, quite easily handled, uniting advantages of the traditional book band 406 and book marks, and improving disadvantage of easily falling off of the traditional book band. In addition, the surfaces 31, 32 of the sophisticated flat pinchers 3, 3 have function of advertisement and decoration, provided with new and improved practicability.

While the preferred embodiment of the invention has been described above, it will be recognized and understood that various modifications may be made thereto and the appended claims are intended to cover all such modifications which may fall within the spirit and scope of the invention.

What is claimed is:

1. A book band assembly for a book having a front page, a back page and a plurality of intermediate pages disposed between a front cover and a rear cover, the assembly comprising:

a) a pair of elongate flat pinchers, each pincher including an inner end and an outer end, the pinchers being longitudinally positioned with the inner ends defining a space therebetween, the pinchers being sized for extending across the collective thickness of the pages at a top side of the book;

b) a lateral band extending through the pinchers and outwardly from the outer ends thereof to define a front band portion for disposition between the front page and the front cover and a back band portion for disposition between the back page and the rear cover, the band including a band body formed from soft fine woven string, an adhesive layer coated on a lower surface of the band body and a removable paper temporarily covering the adhesive layer, whereby the front band portion and the rear band portion may be adhered to the front and back pages when corresponding portions of the removable paper are removed therefrom; and c) a plurality of colored book bands, each book band including an upper end, the upper ends of the book bands being received within the pinchers and secured thereto, with the book bands extending from the space between the inner ends of the pinchers for selective individual pinching between any two pages of the book to indicate the location of the pages.

* * * * *